United States Patent [19]

Sakauye

[11] 4,178,717

[45] Dec. 18, 1979

[54] DEVICE FOR SEALING THE GAP UNDER A DOOR

[76] Inventor: Wallace S. Sakauye, 1333 Heulu St. Apt. #604, Honolulu, Hi. 96822

[21] Appl. No.: 896,064

[22] Filed: Apr. 13, 1978

[51] Int. Cl.[2] ..... E06B 7/00; E06B 7/16

[52] U.S. Cl. ..... 49/70; 16/82; 49/475; 297/343

[58] Field of Search ..... 49/475, 70, 406, 383, 49/472, 473; 160/40; 292/342, 343; 16/82

[56] References Cited

U.S. PATENT DOCUMENTS 1,888,294 11/1932 Tremblay et al. ..... 49/475

3,706,112 12/1972 Newell ..... 292/343 X 3,946,524 3/1976 Budich ..... 49/425 X

FOREIGN PATENT DOCUMENTS 21801 of 1893 United Kingdom ..... 49/406

*Primary Examiner*—Philip C. Kannan

*Attorney, Agent, or Firm*—Beveridge, DeGrandi, Kline & Lunsford

[57] ABSTRACT

The gap under a door is sealed by a removable device which is unconnected to the door. The device has a floor-supported base portion which extends under the door and an inclined sealing flange which contacts the door face.

5 Claims, 2 Drawing Figures

DEVICE FOR SEALING THE GAP UNDER A DOOR

BACKGROUND AND SUMMARY

This invention relates to a device for sealing the gap under a door.

Occupied spaces such as homes, apartments, hotel rooms and the like are often not provided with anything to close the gap beneath their doors. If no sealing device is used beneath the door, noise, air, insects, dust and other pollutants may pass through the gap and enter the occupied space. This reduces the comfort, privacy and cleanliness of the occupied space. If the door is an exterior door, cold air may enter during the winter months and hot air may enter during the summer months, adding to the expense of keeping the occupied space at a comfortable temperature.

A variety of devices are available for sealing such gaps but, to my knowledge, they are all attached to the door. This is unsightly and it creates problems as the devices must not interfere with the swinging movement of the door. When adjusted to enable such swinging movement, these devices are often ineffective to seal the gap when the door is closed. Efforts to avoid this problem have led only to complicated and expensive self-adjusting devices.

SUMMARY OF THE INVENTION

The device of the present invention seals the gap beneath a door conveniently and unobtrusively, to prevent the unwanted entry through the gap of excessive air drafts, insects, noise, dust and other pollutants.

The device has a length approximately equal to the door width. It includes a base portion for resting on the floor. A forward tip on the base extends under the door. Spaced from the tip portion and extending upwardly from the base is a sealing flange with forwardly-inclined upper and lower surfaces and a sealing surface which contacts the door face. The device is simply laid in place after the door is closed, and removed when the occupant leaves the room or other occupied space.

Preferably, the base portion extends forwardly toward the door beyond the sealing flange. It is of triangular cross section, having an inclined upper surface and a convexly curved bottom surface. The inclination of the upper surface is in an opposite direction and at a lesser angle than the sealing flange. When in position, i.e. when combined with the door, a tip portion of the base extends beneath the door to obstruct at least a portion of the gap under the door, while the sealing flange performs the primary sealing function.

BRIEF DESCRIPTION OF A PREFERRED EMBODIMENT

Figure 1:
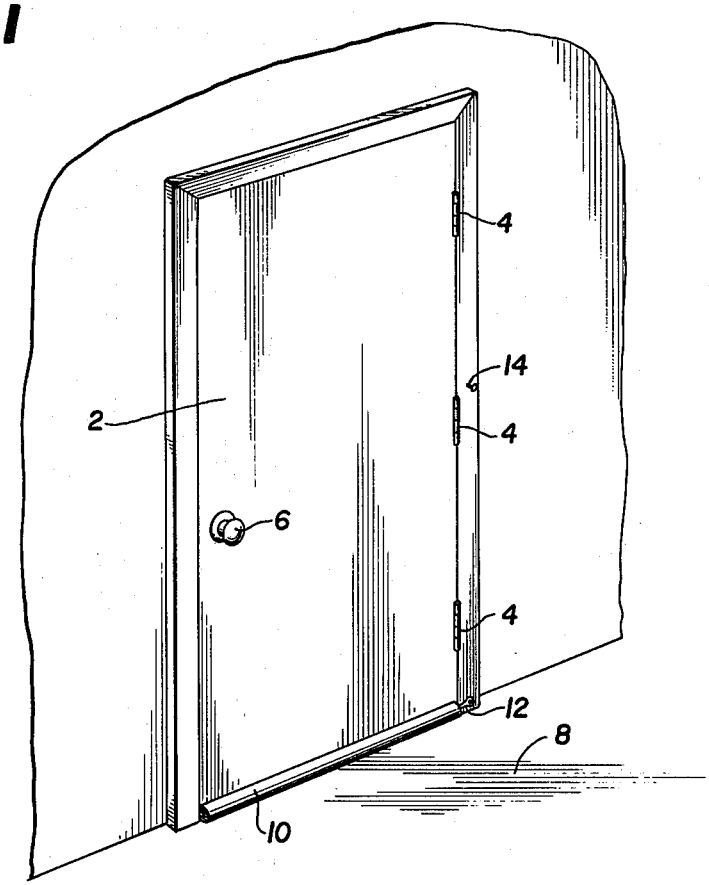
FIG. 1 shows the device in sealing relationship with a closed door.

FIG. 1 shows the interior side of a door 2 supported conventionally in a frame by hinges 4 which permit its swinging movement when opened or closed by the knob 6. The gap between the door 2 and the floor 8 is obstructed by the elongated device 10 which has a length approximately equal to the door width and is constucted according to this invention. The device 10 is not affixed to the door, but has been laid in place after the door was closed. When not in use, the device 10 may be leaned in a corner or hung by eye 12 on a hook 14 in the door molding.

Figure 2:
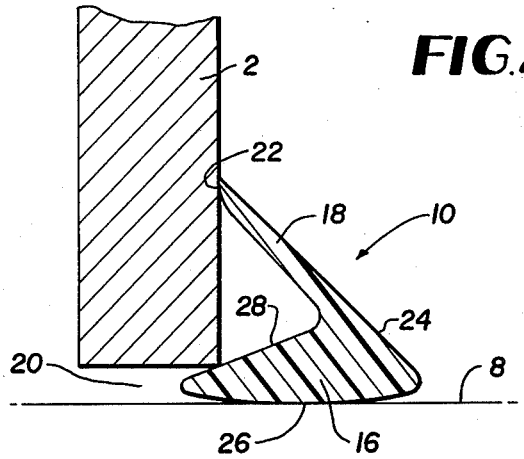
FIG. 2 is a sectional view showing the relationship between the device and the lower portion of a door.

In FIG. 2, it will be seen that the cross section of device 10 includes a generally triangular base portion 16 and an elongated sealing flange 18. The base 16 has a tip portion which extends beneath the bottom surface of the door to obstruct at least a portion of the gap 20; and, the sealing flange 18 has a sealing surface 22 which lies in contact with the vertical face of the door 2. The sealing flange 18 is generally flat and has a surface which is coplanar with the rear face 24 of base 16.

The triangular cross section of the base 16 displays a bottom surface 26 of convex curvature to permit some angular movement of the device when placed against the door 2. The upper inclined surface 28 of the base is inclined in an opposite direction and at a lesser angle than the sealing flange 18. The inclination of surface 28 from the horizontal is about 30° while the inclination of flange 18 is about 45°.

The device may be made of a variety of materials such as molded or extruded plastic or rubber. A satisfactory prototype included a rigid base 16 formed of wood and a resilient sealing flange 18 formed of foam rubber. In devices which are a unitary piece of material, the sealing flange 18 will be somewhat flexible and resilient due to its relative thinness with respect to the base portion 16.

In use, when an occupant enters the room, he closes the door 2 and then places the device in the illustrated position, exerting a slight force against the door to flex the sealing flange 18 and assure that the desired sealing effect is achieved. When he is ready to leave the room, the device is lifted from position and stored as by suspending it by eye 12 from the hook 14.

It will be evident that the device may have configurations which vary from the illustrated form, so it is emphasized that the invention is not limited to the sole disclosed embodiment but is embracing of other devices falling within the spirit of the following claims.

I claim:

1. In combination, a hinged door and a device for sealing the gap under a hinged door, said door having a vertical face and a bottom surface with a gap therebeneath, said device including an elongated member unconnected to the door and having a length approximately equal to the door width, said elongated member having a base portion extending beneath the bottom surface of the door for resting on the floor, said base portion including a forward tip portion inserted under the door and obstructing substantially the entire gap under the door, said elongated member having an elongated sealing flange spaced from said tip portion and having a lower surface which extends from the base portion at an upward and forward inclination, said sealing flange having at its upper end a sealing surface in contact with the door face.

2. The device of claim 1 wherein the forward tip portion extends forwardly beyond the sealing flange so as to extend under the door and at least partially obstruct the gap under a door.

3. The device of claim 1 wherein the base portion has a generally triangular cross section providing three external faces, and the sealing flange is generally flat and has a face which is generally coplanar with one of said external faces of the base portion.

4. The device of claim 1 wherein the base portion has a bottom surface which has a convex curvature to permit some angular movement of the device when placed against a door.

5. The device of claim 1 wherein the base has an upper surface which is inclined in an opposite direction and at a lesser angle than the sealing flange.

* * * * *